US005556304A

United States Patent [19]

Jinno

[11] Patent Number: 5,556,304

[45] Date of Patent: Sep. 17, 1996

[54] ELECTRIC CONNECTION TERMINAL

[75] Inventor: Keishi Jinno, Shizuoka, Japan

[73] Assignee: Yazaki Corporation, Tokyo, Japan

[21] Appl. No.: 411,454

[22] Filed: Mar. 28, 1995

[30] Foreign Application Priority Data

Mar. 28, 1994 [JP] Japan ..... 6-056991

[51] Int. Cl.[6] ..... H01R 13/40

[52] U.S. Cl. ..... 439/595; 439/744; 439/752.5

[58] Field of Search ..... 439/595, 744, 439/752.5, 874

[56] References Cited

U.S. PATENT DOCUMENTS

| | | | |
|---|---|---|---|
| 4,124,264 | 11/1978 | Kato et al. | 439/752.5 |
| 4,776,813 | 10/1988 | Wilson et al. | 439/595 |
| 5,071,369 | 12/1991 | Denlinger et al. | 439/595 |
| 5,085,598 | 2/1992 | Kinoshita | 439/595 |
| 5,108,318 | 4/1992 | Sakurai et al. | 439/595 |
| 5,186,662 | 2/1993 | Yuasa et al. | 439/595 |
| 5,224,876 | 7/1993 | Ito et al. | 439/595 |
| 5,226,839 | 7/1993 | Koumatsu et al. | 439/595 |
| 5,240,434 | 8/1993 | Yagi et al. | 439/595 |
| 5,378,170 | 1/1995 | Abe et al. | 439/752.5 |

*Primary Examiner*—Gary E. Elkins

*Attorney, Agent, or Firm*—Sughrue, Mion, Zinn, Macpeak & Seas

[57] ABSTRACT

An electrical terminal in which a flexible engagement arm of the connector housing is prevented from being deflecting into a concave portion to insure complete insertion of the terminal into the connector housing. The terminal (20) includes an engagement portion with which a forward end (12*a*) of a flexible engagement arm (12) extending into a terminal reception hole engages when the terminal is inserted into the terminal reception hole, a guide surface (2*c*) which is formed in front of the engagement concave portion in the insertion direction so that the forward end of the flexible engagement arm (12) comes into sliding contact against the guide surface at the time of insertion, and a concave portion (26) which is formed in the guide surface (2*c*). The width (b) of the concave portion (26) in the direction perpendicular to the insertion direction is established so as to be smaller than that the width (a) of the forward end (12*a*) of the flexible engagement arm (12).

10 Claims, 3 Drawing Sheets

ELECTRIC CONNECTION TERMINAL

BACKGROUND OF THE INVENTION

1. Field of the Invention

The present invention relates to an electric connection terminal which is receivable in a connector housing or the like.

2. Related Art

FIG. 4 is a perspective view of a conventional electric connection terminal disclosed in Japanese Design Publication No. H1-322A, and FIG. 5 is a sectional view in the state where the same electric connection terminal is used.

The electric connection terminal 1 is a female terminal which has a cylindrical box portion 2 formed at its front end for receiving a male terminal, an electric wire crimping portion 3 formed at its mid-portion, and a sheath crimping portion 4 formed at its rear end. The box portion 2 is constituted by a bottom plate 2*a*, opposite side plates 2*b* and 2*b*, and a top plate 2*c* which is connected to the respective top ends of the side plates. A spring piece 5 for pressure contacting the male terminal is disposed on the bottom plate 2*a*.

The spring piece 5 has a middle portion extending in the longitudinal direction of the terminal which is bent convexly upwardly. Additionally, the terminal has an embossed portion 6 which is deformed inwardly in a concave manner. The embossed portion 6 is formed by inwardly depressing an the mid-portion of the top plate 2*c* opposite to the spring piece 5. The inner surface of this embossed portion 6 acts as a contact surface which faces the spring piece 5 and which comes into contact with the male terminal such that the male terminal is sandwiched therebetween. This embossed portion 6 is provided over the entire width of the top plate 2*c* and is defined by sloping front and rear surfaces.

The portion to the rear of rear edge 2*e* of the box portion 2 is an engagement concave portion 7 which is stepped downwardly. A forward end 12*a* of a lance (which is a flexible engagement arm) 12 extending from the top wall of a terminal reception hole 11 of a connector housing 10 engages with this engagement concave portion 7, so that the electric connection terminal 1 is retained in the chamber of the housing.

Next, the manner in which the electric connection terminal 1 is installed in the chamber of connector housing will be described with reference to FIG. 5. First, the forward end of a conductor 16 of a wire 15 is crimped by the wire crimping portion 3 of the electric connection terminal 1. In this condition, the electric connection terminal 1 is inserted into the terminal reception chamber 11 of the connector housing 10 from the rear. As shown in FIG. 6A, during the insertion of the terminal, the lance 12 is abutted by the top plate 2*c* of the box portion 2 so as to be bent upwardly, so that the forward end 12*a* of the lance 12 slides on and contacts with the outer top surface 2*c* as the box portion 2 moves inwardly, as shown in FIGS. 6B and 6C. When the rear edge 2*e* of the terminal passes beyond forward end 12*a*, the lance 12 is restored to its original state elastically, so that the forward end 12*a* engages the engagement concave portion 7. As can be seen from the foregoing, the upper surface of the top plate 2*c* of the box portion 2 acts as a guide surface on which the lance 12 slides while contacting therewith.

The problem with this conventional arrangement is as follows. When the terminal includes a concave portion such as the embossed portion 6 on the guide surface (the upper surface of the top plate 2*c*) in front of the engagement concave portion 7, the lance 12 is partially restored to its original state elastically when the forward end 12*a* of the lance is received in the concave portion. This can be mistaken by the operator as complete engagement when, in fact, the terminal has not been sufficiently advanced to allow for the lance 12 to engage with the engagement concave portion 7. Accordingly, there is a fear that a worker may not insert the terminal completely into the chamber of the connector housing.

SUMMARY OF THE INVENTION

Taking the foregoing problem into consideration, the present invention has an object to provide an electric connection terminal which can prevent a worker from mistakenly not inserting the terminal completely into the housing.

According to a first aspect of the present invention, the electric connection terminal comprises: an engagement concave portion adapted to engage with a forward end of a flexible engagement arm formed in a terminal reception hole when the electric connection terminal is inserted into the terminal reception hole; a guide surface which is formed in front of the engagement concave portion in the insertion direction so that the forward end of the flexible engagement arm comes into sliding contact with the guide surface; and a concave portion formed on the guide surface wherein the width of the concave portion in the direction perpendicular to the insertion direction is smaller than that of the forward end of the flexible engagement arm.

According to a second aspect of the present invention, an electric connection terminal comprises an engagement concave portion adapted to engage with a forward end of a flexible engagement arm formed in a terminal reception hole when the electric connection terminal is inserted into the terminal reception hole, a guide surface which is formed in front of the engagement concave portion in the insertion direction so that the forward end of the flexible engagement arm comes into sliding contact with the guide surface, and a concave portion formed on the guide surface, wherein the position of the concave portion is shifted from the position where the forward end of the flexible engagement arm passes.

According to a third aspect of the present invention, an electric connection terminal comprises an engagement concave portion adapted to engage with a forward end of a flexible engagement arm formed in a terminal reception hole when the electric connection terminal is inserted into the terminal reception hole, a guide surface which is formed in front of the engagement concave portion in the insertion direction so that the forward end of the flexible engagement arm comes into sliding contact with the guide surface, and a concave portion formed on the guide surface, wherein the concave portion is formed divisionally into a plurality of concave portions so that a deflecting prevention portion for preventing the forward end of the flexible engagement arm from deflecting downwardly is provided between the concave portions.

According to a fourth aspect of the present invention, an electric connection terminal comprises an engagement concave portion adapted to engage with a forward end of a flexible engagement arm formed in a terminal reception hole when the electric connection terminal is inserted into the terminal reception hole, a guide surface which is formed in front of the engagement concave portion is the insertion direction so that the forward end of the flexible engagement arm comes into sliding contact with the guide surface, and a concave portion formed on the guide surface, wherein the width of the concave portion in the insertion direction is smaller than that of a lower surface of the flexible engagement arm.

According to a fifth aspect of the present invention, preferably in any of the first to fourth aspects, the guide surface is provided on an outer surface of a cylindrical box portion for receiving an associated male terminal, and the concave portion is formed as an embossed portion for forming a contact surface, inside the box portion, against the male terminal.

According to the first aspect of the present invention, since the width of the concave portion is smaller than the width of the forward end of the flexible engagement arm, there is no fear that the forward end of the flexible engagement arm will be received in the concave portion when the forward end of the flexible engagement arm passes the concave portion. Therefore, once deflected, the flexible engagement arm does not elastically restore itself to its original state until such time that the terminal reaches its proper position.

Since, according to the second aspect of the present invention, the position of the concave portion is shifted from the position where the forward end of the flexible engagement arm passes, the flexible engagement arm will not be deflected into the concave portion.

Since, according to the third aspect of the present invention, the concave portion is divided into a plurality of concave portions, and a deflecting prevention portion is provided between the concave portions, the forward end of the flexible engagement arm will not deflect into the concave portion.

Similarly, according to the fourth aspect of the present invention, the engagement arm will not deflect into the concave portion since the width of the concave portion is smaller than the associated engaging surface of the flexible arm in the insertion direction.

Finally, according to the fifth aspect of the present invention, since the concave portion is an embossed portion which contacts the male terminal, the area of the contact surface with the male terminal depends on the size of the concave portion.

DETAILED DESCRIPTION OF THE PREFERRED EMBODIMENT OF THE INVENTION

An embodiment of the present invention will be described with reference to the drawings.

Figure 1:
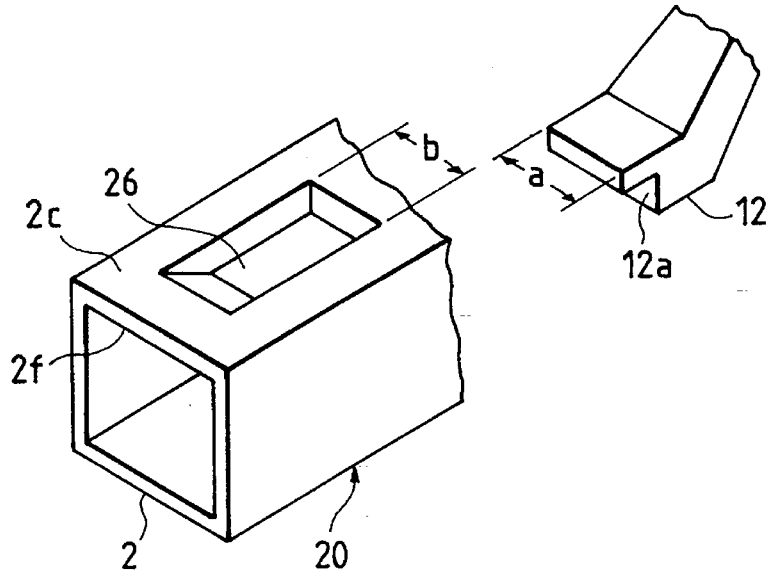
FIG. 1 is a perspective view illustrating the relationship between an electric connection terminal and a lance in an embodiment of the present invention.

FIG. 1 is a perspective view showing the relationship between an electric connection terminal 20 and a lance (flexible engagement arm) 12 according to a first embodiment of the invention.

In the electric connection terminal 20 in this embodiment, the width b in the direction perpendicular to the terminal insertion direction of an embossed or concave portion 26 is smaller than the width a of a forward end 12*a* of the lance 12. Accordingly, the forward end 12*a* of the lance 12 will not deflect into the embossed or concave portion 26 when the forward end 12*a* of the lance 12 passes over the embossed or concave portion 26.

Therefore, the deflected lance 12 will not be restored to its original state until the electric connection terminal 20 has been completely inserted to its proper position. As a result, there is no fear that the terminal will be incompletely inserted.

This embodiment is remarkably effective in the case where the position of the embossed or concave portion 26 or the position of the lance 12 cannot be changed.

Although the lance 12 can be prevented from deflecting into engagement with the concave portion in the manner discussed above, the same effect can be obtained by shifting the position of the embossed or concave portion 26 from the position where the forward end 12*a* of the lance 12 passes. This is recommended in the case where the width of the embossed or concave portion 26 cannot be made smaller for some reason.

Figure 2:
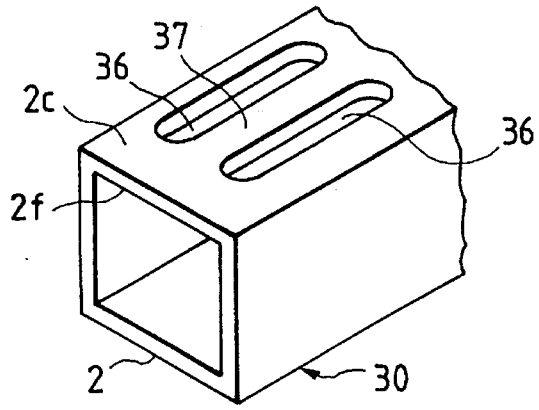
FIG. 2 is a perspective view illustrating the structure of the upper surface of an electric connection terminal in another embodiment of the present invention.

FIG. 2 is a perspective view showing a forward end portion of an electric connection terminal 30 according to yet another embodiment of the invention. In this electric connection terminal 30, an embossed or concave portion is divided into two parts in the direction perpendicular to the terminal insertion direction. That is, two embossed or concave portions 36 and 36 are provided in a top plate 2*c* of a box portion 2 in a parallel manner. A deflecting prevention wall 37, for preventing a forward end 12*a* of a lance 12 from deflecting downwardly, is provided between the embossed or concave portions 36 and 36.

Thus, even if the forward end 12*a* of the lance 12 passes over the embossed or concave portions 36 and 36, the deflecting prevention wall 37 prevents the forward end 12*a* of the lance 12 from deflecting downwardly, so that the forward end 12*a* will not be engaged in the embossed or concave portions 36. Therefore, this embodiment has an effect similar to that in the above-mentioned embodiment. In addition, the inner surfaces of the two embossed or concave portions 36 act as contact surfaces for contacting a male terminal when it is received in the female terminal. Since the contact surfaces are formed as two projecting strips, the resistance of terminal insertion caused by friction is reduced, and the contact is stabilized.

Figure 3:
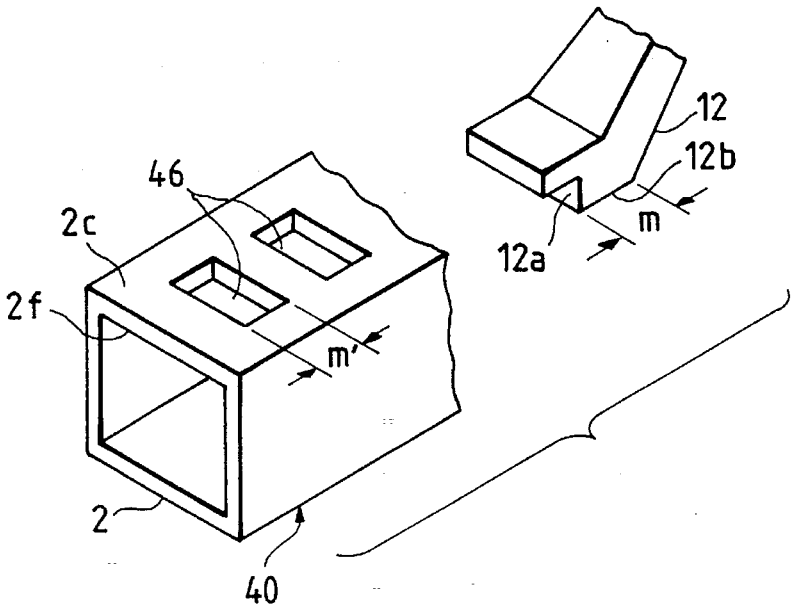
FIG. 3 is a perspective view illustrating the relationship between an electric connection terminal and a lance in a further embodiment of the present invention.
Figure 4:
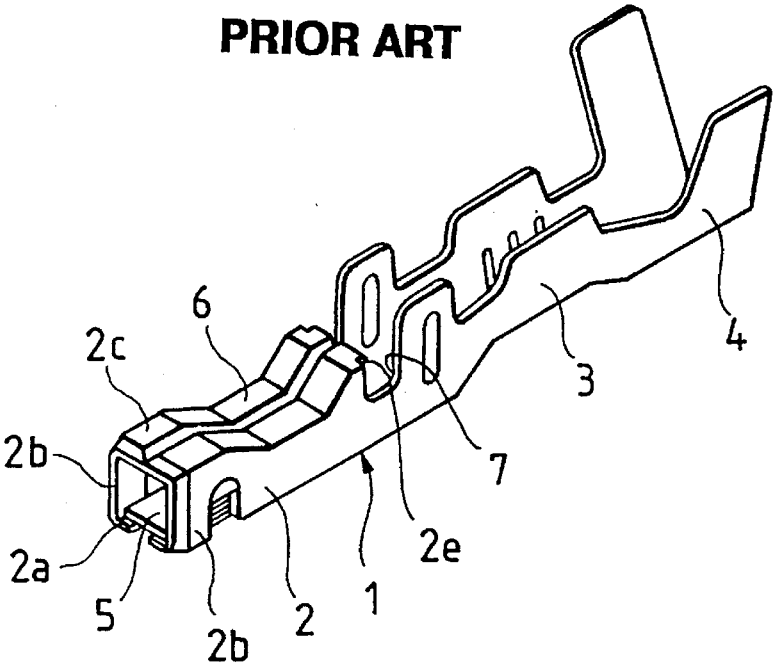
FIG. 4 PRIOR ART
FIG. 4 is a perspective view illustrating an example of a conventional female electric connection terminal.
Figure 5:
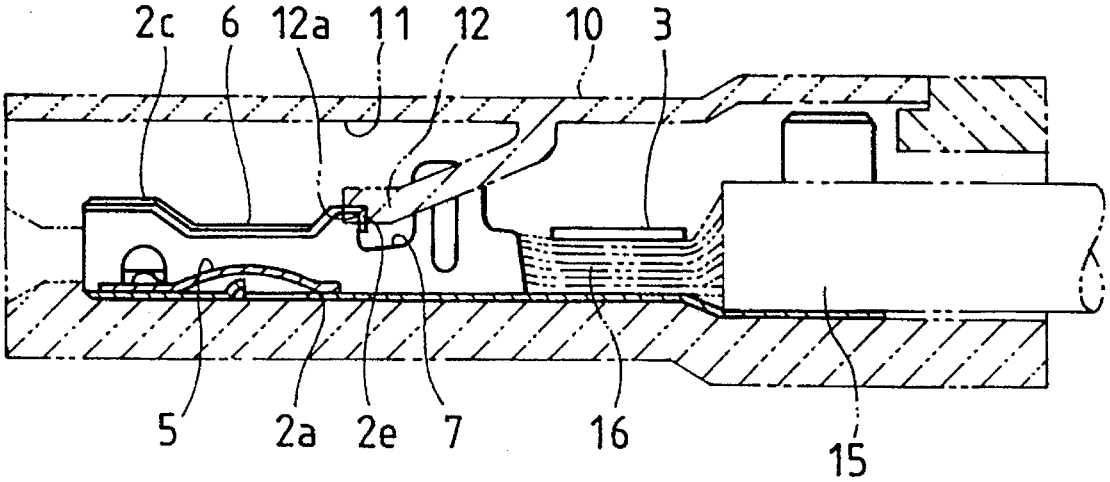
FIG. 5 PRIOR ART
FIG. 5 is a sectional view of a connector in which the electric connection terminal in FIG. 3 is installed.
Figure 6A:
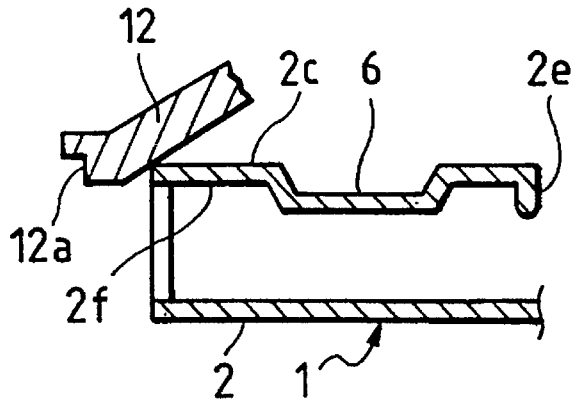
FIG. 6(a) PRIOR ART
FIGS. 6(*a*), (*b*) and (*c*) are side views illustrating the relationship between a lance and an electric connection terminal in the respective steps in the process of inserting the electric connection terminal in a conventional connector.
Figure 6B:
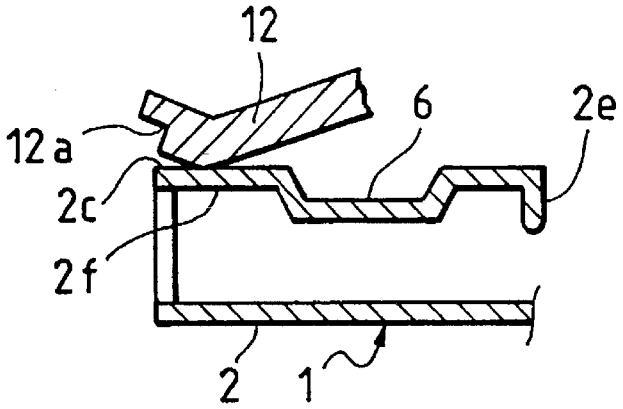
FIG. 6(b) PRIOR ART
Figure 6C:
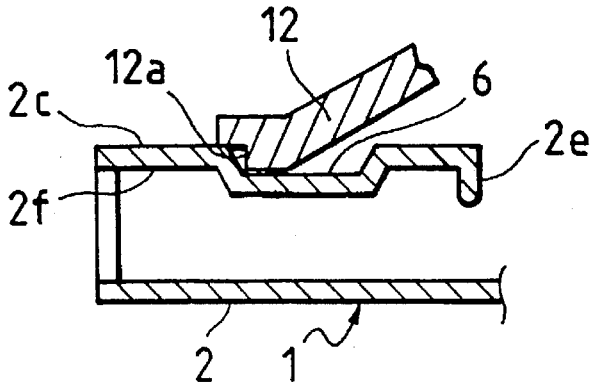
FIG. 6(c) PRIOR ART

FIG. 3 shows an electric connection terminal 40 according to a further embodiment of the present invention. In this electric connection terminal 40, two embossed or concave portions 46 and 46 are sequentially formed in the insertion direction, and the width m' of each of the embossed or concave portions 46 and 46 in the terminal inserting direction is smaller than the width m of a lower surface 12*b* of a lance 12 in the terminal insertion direction.

Consequently, the lance 12 will not be engaged in the embossed or concave portions 46. Therefore, this embodiment has an effect similar to that of the above-mentioned embodiments. In addition, this embodiment provides a remarkable effect in the case where the width of each of the embossed or concave portions 46 and 46 in the direction perpendicular to the terminal insertion direction cannot be changed.

Although the above embodiments have been described as including concave embossed portions 26, 36 and 46 which form contact surfaces for contacting male terminals, it is understood that any concave portions other than such embossed portions may be used. However, it is important that the concave portion be disposed in front of the engagement concave portion.

We claim:

1. An electric connection terminal comprising:

an engagement portion adapted to be engaged by a forward end of a flexible engagement arm formed in a terminal reception hole when said electric connection terminal is inserted into said terminal reception hole;

a guide surface formed forwardly of said engagement portion in the insertion direction, said forward end of said flexible engagement arm sliding along said guide surface when the terminal is inserted into the reception hole; and a concave portion formed on said guide surface, the width of said concave portion in the direction perpendicular to said insertion direction being smaller than the width of said forward end of said flexible engagement arm so that said forward end does not deflect into said concave portion.

2. The electric connection terminal of claim 1, wherein said concave portion includes a pair of concave sections disposed adjacent each other and defining a deflecting preventing portion therebetween along which said forward end slides during insertion of said terminal.

3. The electric connection terminal of claim 1, wherein said guide surface is provided on an outer surface of a cylindrical box portion of said terminal in which an associated male terminal is receive and wherein said concave portion is embossed on an inside surface thereof which contacts said male terminal.

4. An electric connection terminal, comprising:

an engagement portion adapted to be engaged by a forward end of a flexible engagement arm formed in a terminal reception hole when said electric connection terminal is inserted into said terminal reception hole;

a guide surface formed forwardly of said engagement portion in the insertion direction, said forward end of said flexible engagement arm sliding along said guide surface when said terminal is inserted into said reception hole; and a concave portion formed on said guide surface, wherein the position of said concave portion is displaced from the position where said forward end of said flexible engagement arm passes during insertion of said terminal into said reception hole.

5. The electric connection terminal of claim 4, wherein said guide surface is provided on an outer surface of a cylindrical box portion of said terminal in which an associated male terminal is receive and wherein said concave portion is embossed on an inside surface thereof which contacts said male terminal.

6. An electric connection terminal comprising:

an engagement portion adapted to be engaged by a forward end of a flexible engagement arm formed in a terminal reception hole when said electric connection terminal is inserted into said terminal reception hole;

a guide surface formed forwardly of said engagement portion in the insertion direction, said forward end of said flexible engagement arm sliding along said guide surface when the terminal is inserted into the reception hole; and a plurality of concave portions formed on said guide surface and defining a deflecting preventing portion therebetween along which said forward end slides during insertion of said terminal.

7. The electric connection terminal of claim 6, wherein said guide surface is provided on an outer surface of a cylindrical box portion of said terminal in which an associated male terminal is receive and wherein said concave portion is embossed on an inside surface thereof which contacts said male terminal.

8. The terminal of claim 6, wherein the width of said concave portions in the direction perpendicular to said insertion direction are smaller than the width of said forward end of said flexible engagement arm so that said forward end does not deflect into said concave portion.

9. An electric connection terminal comprising:

an engagement portion adapted to be engaged by a forward end of a flexible engagement arm formed in a terminal reception hole when said electric connection terminal is inserted into said terminal reception hole in an insertion direction, said forward end having a predetermined length in said insertion direction;

a guide surface formed forwardly of said engagement concave portion in the insertion direction, said flexible engagement arm sliding along said guide surface when said terminal is inserted into said reception hole; and a concave portion formed on said guide surface having a length in said insertion direction smaller than said predetermined length of said forward end so that said forward end does not become engaged therein.

10. The electric connection terminal of claim 9, wherein said guide surface is provided on an outer surface of a cylindrical box portion of said terminal in which an associated male terminal is receive and wherein said concave portion is embossed on an inside surface thereof which contacts said male terminal.

* * * * *